US008038415B2

(12) United States Patent
Park et al.

(10) Patent No.: US 8,038,415 B2
(45) Date of Patent: Oct. 18, 2011

(54) VARIABLE CAPACITY SWASH PLATE TYPE COMPRESSOR

(75) Inventors: Tae Young Park, Daejeon (KR); Hew Nam Ahn, Daejeon (KR); Young Seop Yoon, Daejeon (KR)

(73) Assignee: Halla Climate Control Corp., Daejeon (KR)

( * ) Notice: Subject to any disclaimer, the term of this patent is extended or adjusted under 35 U.S.C. 154(b) by 623 days.

(21) Appl. No.: 12/129,877

(22) Filed: May 30, 2008

(65) Prior Publication Data

US 2008/0298981 A1 Dec. 4, 2008

(30) Foreign Application Priority Data

Jun. 1, 2007 (KR) ..... 10-2007-0054078

(51) Int. Cl.
*F04B 1/26* (2006.01)

(52) U.S. Cl. ..... 417/222.2; 184/6.17

(58) Field of Classification Search ..... 417/269, 417/270, 272, 222.1, 222.2; 91/499, 505; 184/6.17
See application file for complete search history.

(56) References Cited

U.S. PATENT DOCUMENTS 5,636,973 A * 6/1997 Sonobe et al. ..... 417/222.2
6,942,465 B2 * 9/2005 Kawachi et al. ..... 417/269

FOREIGN PATENT DOCUMENTS

| | | |
|---|---|---|
| DE | 197 03 216 A1 | 8/1997 |
| EP | 0 943 802 A2 | 9/1999 |
| JP | 55 29041 | 3/1980 |
| JP | 2009 24567 | 2/2009 |

* cited by examiner

*Primary Examiner* — Charles G Freay
*Assistant Examiner* — Patrick Hamo
(74) *Attorney, Agent, or Firm* — Rabin & Berdo, PC

(57) ABSTRACT

Provided is a variable capacity swash plate type compressor. The variable capacity swash plate type compressor includes: a cylinder block; a front housing; a rear housing; a valve; a driving shaft; a rotor; a swash; an elastic; and a plurality of pistons, wherein at least one step portion perforating the rotor and the driving shaft, communicating the crank chamber and the refrigerant communication passage, and protruding toward its inner face so that a cross-section of the at least one step portion is reduced in a direction of the refrigerant communication passage from the crank chamber toward an inner face of the step portion, is provided, and at least one oil separation passage in which oil is centrifugally separated from a refrigerant gas flowing inside the driving shaft as the driving shaft rotates is formed.

4 Claims, 8 Drawing Sheets

VARIABLE CAPACITY SWASH PLATE TYPE COMPRESSOR

CROSS-REFERENCE TO RELATED PATENT APPLICATIONS

This application claims the benefit of Korean Patent Application No. 10-2007-0054078, filed on Jun. 1, 2007, in the Korean Intellectual Property Office, the disclosure of which is incorporated herein in its entirety by reference.

BACKGROUND OF THE INVENTION

1. Field of the Invention

The present invention relates to a compressor used in an air conditioning system for a car, and more particularly, to a variable capacity swash plate type compressor which changes the capacity of discharge by adjusting the pressure of a crank chamber.

2. Description of the Related Art

In general, swash plate compressors include fixed capacity type swash plate compressors and variable capacity swash plate type compressors according to use. Variable capacity swash plate type compressors among them change the angle of inclination of a swash plate by using a control valve depending on a change in load and control the quantity of transportation of a piston to achieve precise control, and simultaneously change an angle of inclination continuously to reduce a rapid change in torque of an engine due to the compressor so that the feeling of smoothly riding a car can be increased.

FIG. 1 is a cross-sectional view of a conventional variable capacity swash plate type compressor.

As illustrated in FIG. 1, the conventional variable capacity swash plate type compressor comprises a cylinder block 12 in which a plurality of cylinder bores 12*a* are formed, a front housing 11 which is sealed and connected to the front side of the cylinder block 12, and a rear housing 13 which is sealed and connected to the rear side of the cylinder block 12 by interposing a valve unit 14 between the cylinder block 12 and the rear housing 13.

A crank chamber 15 is formed inside the front housing 11. One side of a driving shaft 16 is rotatably supported near the center of the front housing 11. The other end of the driving shaft 16 passes the crank chamber 15 and is rotatably supported by the cylinder block 12.

A rotor 23 and a swash plate 24 are installed on the driving shaft 16, and a spring 25 for elastically supporting the swash plate 24 is interposed between the rotor 23 and the swash plate 24.

A ball 26 is formed at one side of the swash plate 24. Thus, as the rotor 23 rotates, the ball 26 of the swash plate 24 is moved to be slid in a guide hole of the rotor 23, and an angle of inclination of the swash plate 24 is changed. In addition, pistons 21 are inserted by inserting a shoe 27 in the outer peripheral face of the swash plate 24 and make a reciprocating motion within each of the cylinder bores 12*a* of the cylinder block 12.

Each of a suction chamber 31 and a discharge chamber 32 is formed in the rear housing 13. The suction chamber 31 and the discharge chamber 32 are connected to an outside of the compressor via an external refrigerant circuit (not shown).

Meanwhile, an oil separator 39 is installed at the rear end of the driving shaft 16 and is encompassed by an oil chamber 40. A communication hole 42 connecting the crank chamber 15 and the oil separator 39 is formed in the driving shaft 16. The oil separator 39 is formed in the form of a cylindrical cap.

When the compressor operates, the pressure of the crank chamber 15 is changed (for example, from a low pressure to a high pressure) according to manipulation of the control valve 38 so that a refrigerant remaining in the crank chamber 15 is exhausted toward the suction chamber 31 via the oil separator 39 along the communication hole 42 of the driving shaft 16. A refrigerant gas passing the oil separator 39 and being near an inner circumference of the oil separator 39 rotates together with the oil separator 39. Oil in a mist phase that exists in the refrigerant gas is centrifugally separated from the refrigerant gas.

The oil that is centrifugally separated by the oil separator 39 in this manner is attached to the inner circumference of the oil separator 39 and is moved to be slid toward the rear end of the oil separator 39. The oil is exhausted to the outside through a gap between the front end of the oil separator 39 and the vale unit 14 or a trough portion 39*b* and stays in the oil chamber 40.

In addition, the oil is continuously induced to an air supply passage 37 through a communication passage 40*a* and is returned to the crank chamber 15 by using a refrigerant gas etc.

However, according to the conventional variable capacity swash plate type compressor, an additional oil separator 39 is needed, and a space for installing the oil separator 39 is required. Thus, there is a limitation in designing and assembling the compressor. Furthermore, oil passes the communication passage 40*a* of the driving shaft 16, the suction chamber 31, and the air supply passage 37 etc. sequentially together with a refrigerant so that loss of oil due to a long flow path occurs inevitably.

SUMMARY OF THE INVENTION

The present invention provides a variable capacity swash plate type compressor having a simple structure and being easily assembled, in which an oil separation function is sufficiently performed without provision of an additional oil separator.

The present invention also provides a variable capacity swash plate type compressor which minimizes loss of oil by reducing the length of a path in which oil flows together with a refrigerant.

According to an aspect of the present invention, there is provided a variable capacity swash plate type compressor, the compressor including: a cylinder block having a plurality of cylinder bores; a front housing mounted in front of the cylinder block and forming a crank chamber inside the front housing; a rear housing mounted in rear of the cylinder block and having a defining wall defining a suction chamber and a discharge chamber inside the rear housing; a valve unit installed between the cylinder block and the rear housing and inhaling and exhausting a refrigerant; a driving shaft in which a refrigerant communication passage communicating the suction chamber is formed and which is rotatably installed on the cylinder block and the front housing; a rotor connected to the driving shaft inside the crank chamber and rotating together with the driving shaft; a swash plate connected to a hinge arm of the rotor to be flowed and connected to the driving shaft so that an angle of inclination with respect to a change in the pressure of the crank chamber is changed; an elastic body installed between the rotor and the swash plate and returning the swash plate to its initial position; and a plurality of pistons interlocking with rotation of the swash plate and making a reciprocating motion within the cylinder bores, wherein at least one step portion perforating the rotor and the driving shaft, communicating the crank chamber and the refrigerant communication passage, and protruding toward its inner face so that a cross-section of the at least one step portion is reduced in a direction of the refrigerant communication passage from the crank chamber toward an inner face of the step portion, is formed, and at least one oil separation passage in which oil is centrifugally separated from a refrigerant gas flowing inside the driving shaft as the driving shaft rotates is formed.

The step portion may be formed in an oil separation passage within the rotor.

The suction chamber may be formed outside the defining wall, and the defining wall may include a connection passage so that the refrigerant communication passage and the suction chamber communicate with each other, and a connection hole may be formed in the valve unit.

The compressor may further include a bush formed between the driving shaft and the cylinder block and supporting rotation of the driving shaft and simultaneously preventing leakage of a refrigerant.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
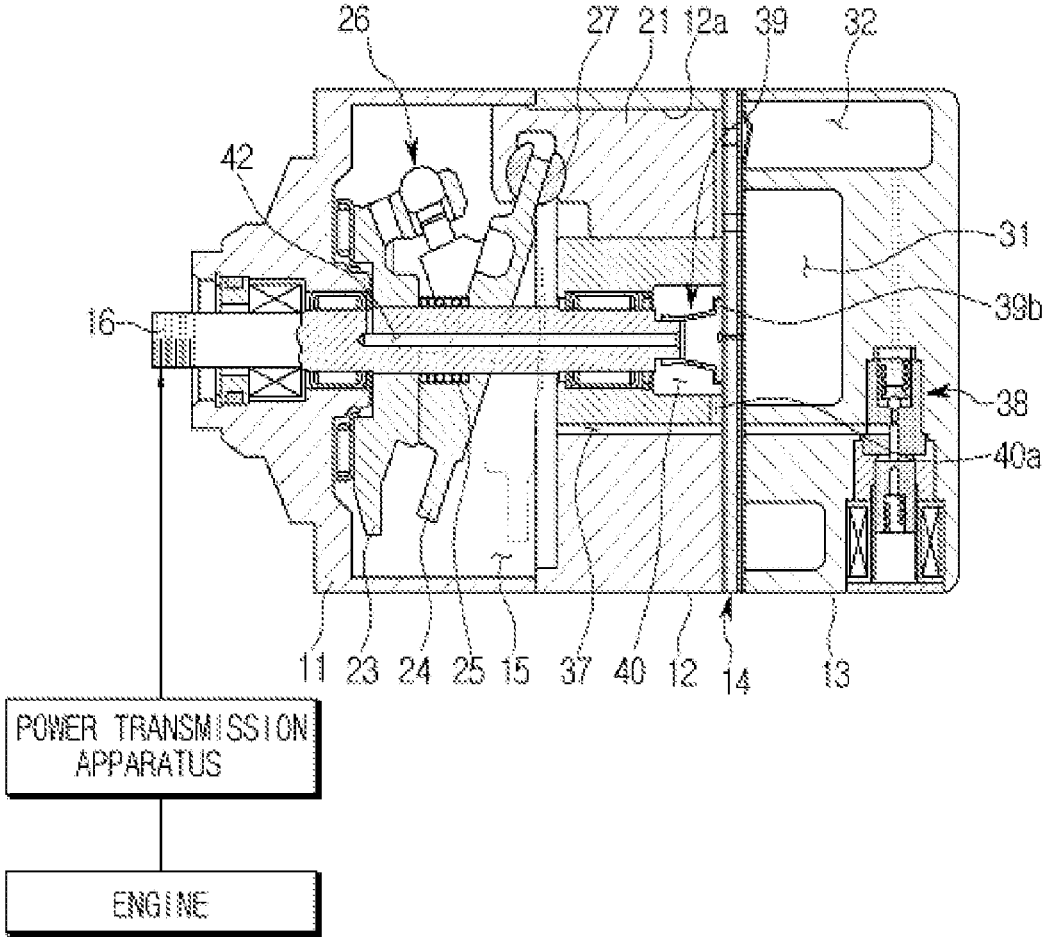
Fig. 1 PRIOR ART
FIG. 1 is a cross-sectional view of a conventional variable capacity swash plate type compressor.

The present invention will now be described more fully with reference to the accompanying drawings, in which exemplary embodiments of the invention are shown. The following embodiments just illustrate the present invention, and the scope of the present invention is not limited to the following embodiments.

Accordingly, the embodiments described in the present specification and the configuration shown in the drawings are just exemplary embodiments of the present invention and do not represent all of the technical spirit of the present invention. Thus, it should be understood that there may be various equivalents and modified examples that can replace the embodiments described in the present specification and the configuration shown in the drawings at the time of filling the present application.

Figure 2:
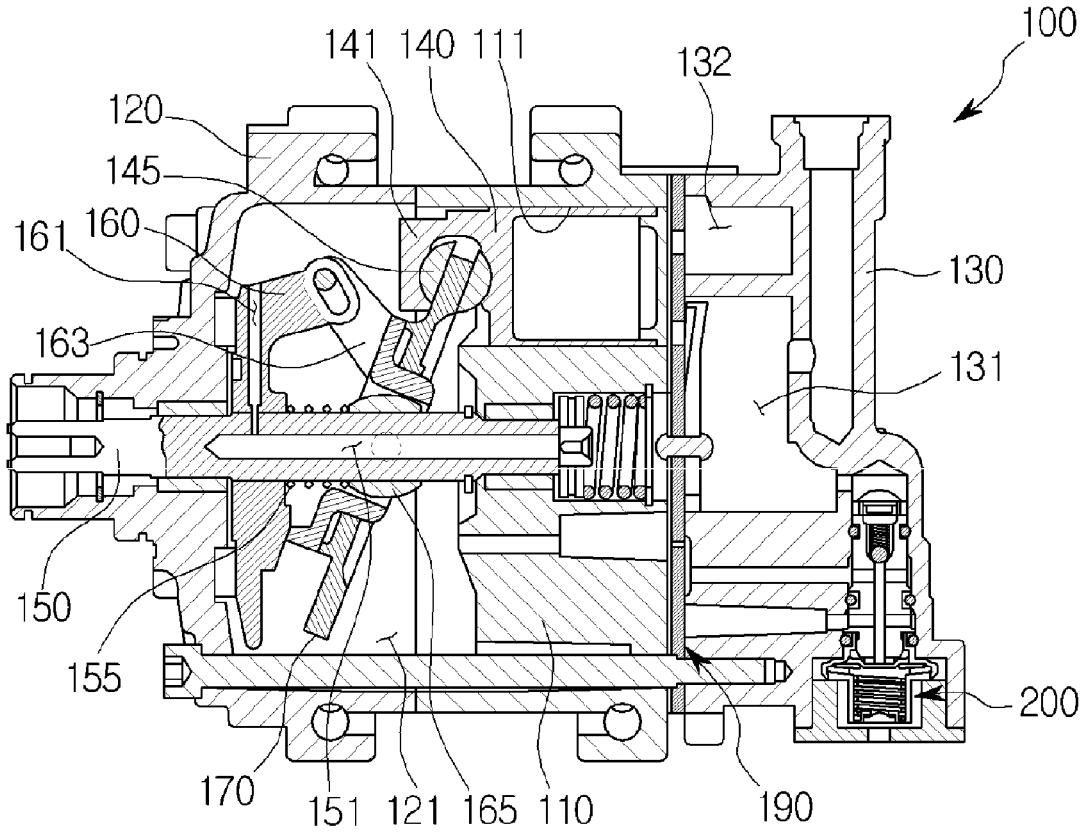
FIG. 2 is a cross-sectional view of a variable capacity swash plate type compressor according to an embodiment of the present invention.
Figure 3:
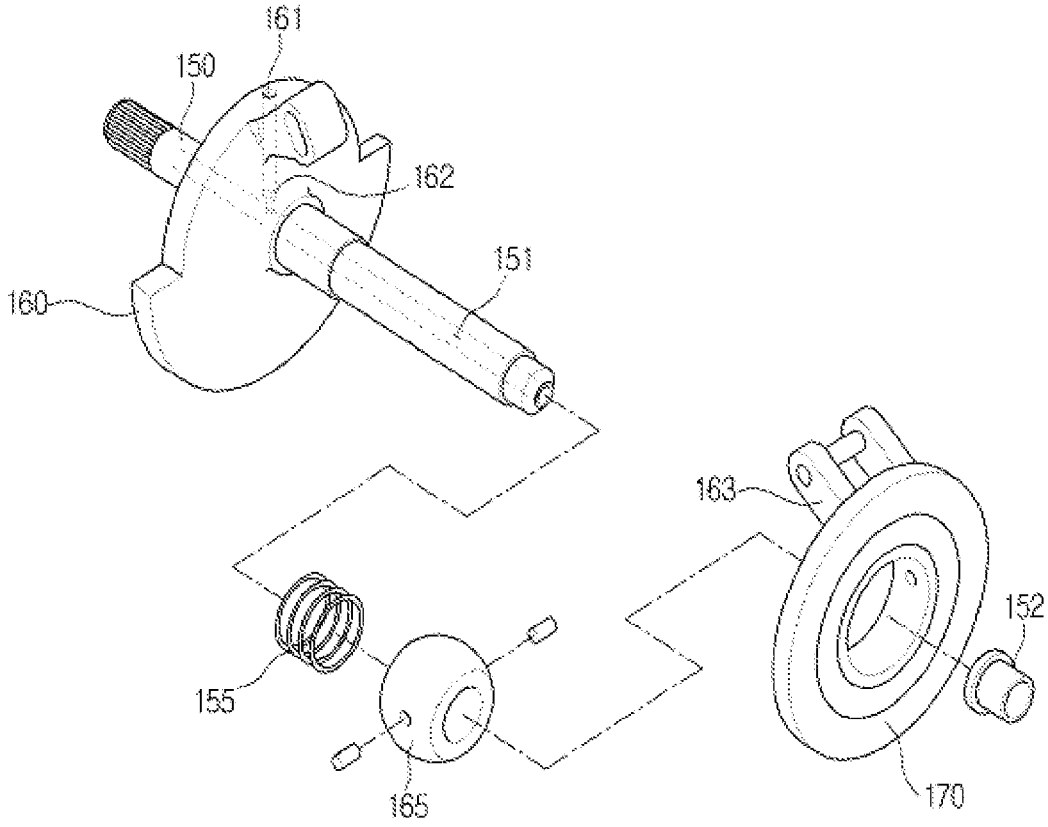
FIG. 3 is an exploded perspective view of a rotor, a swash plate, and a driving shaft illustrated in FIG. 2.
Figure 4:
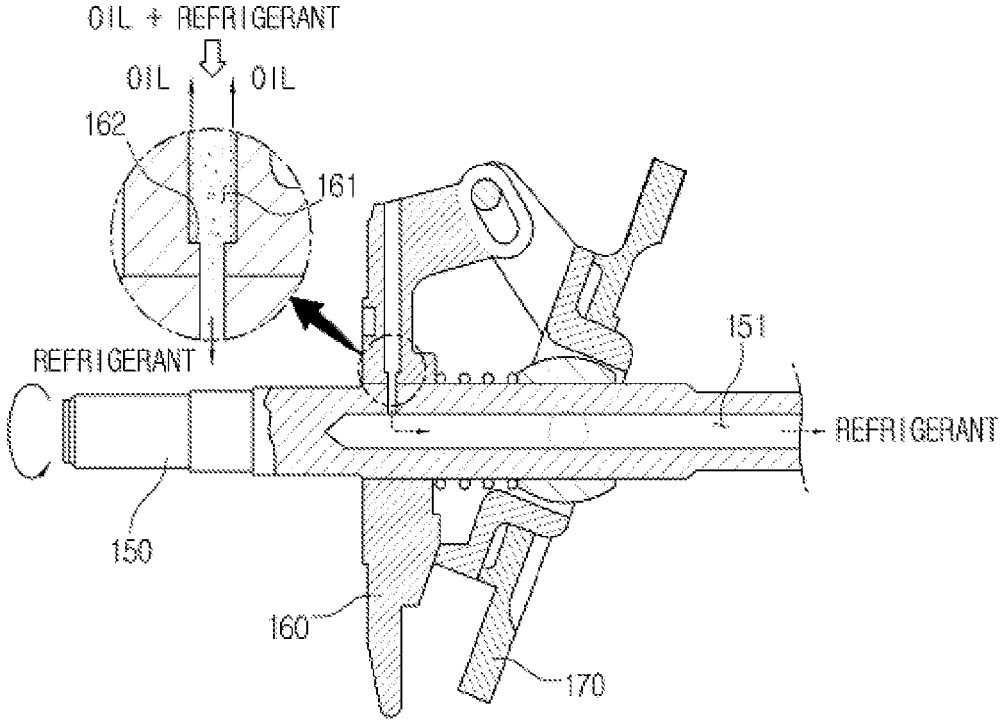
FIG. 4 is a cross-sectional view of an operation of separating oil from a rotor and a driving shaft illustrated in FIG. 2.
Figure 5A:
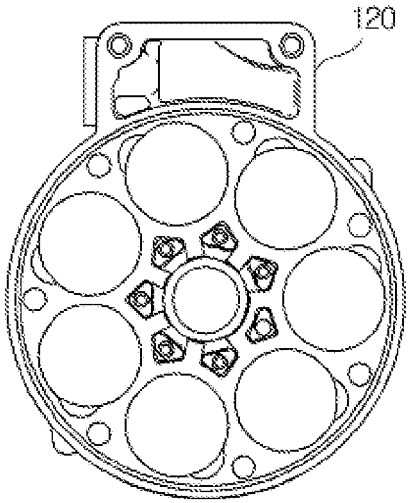
FIG. 5A is a front view of a front housing illustrated in FIG. 2.
Figure 5B:
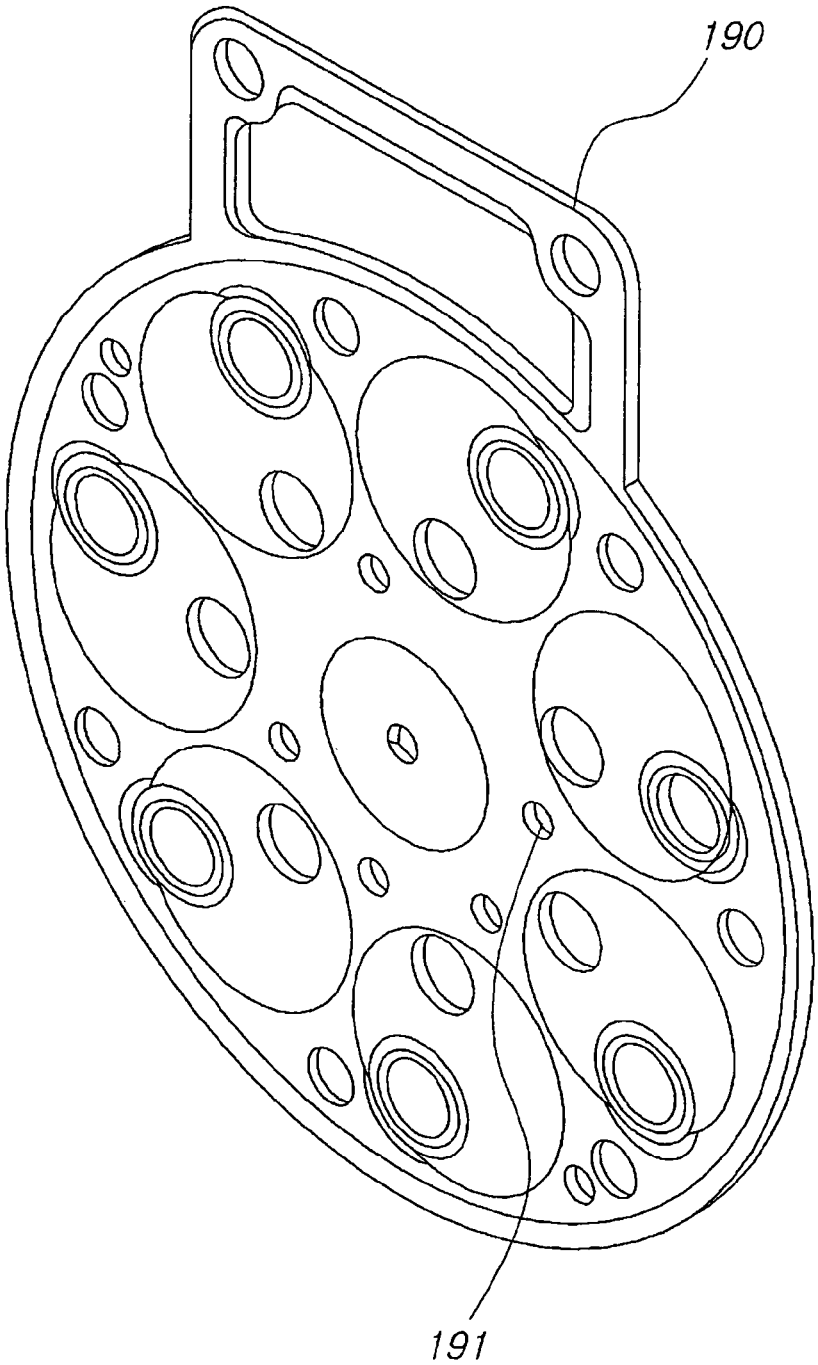
FIGS. 5B and 5C are perspective views of a valve unit and a rear housing illustrated in FIG. 2.
Figure 5C:
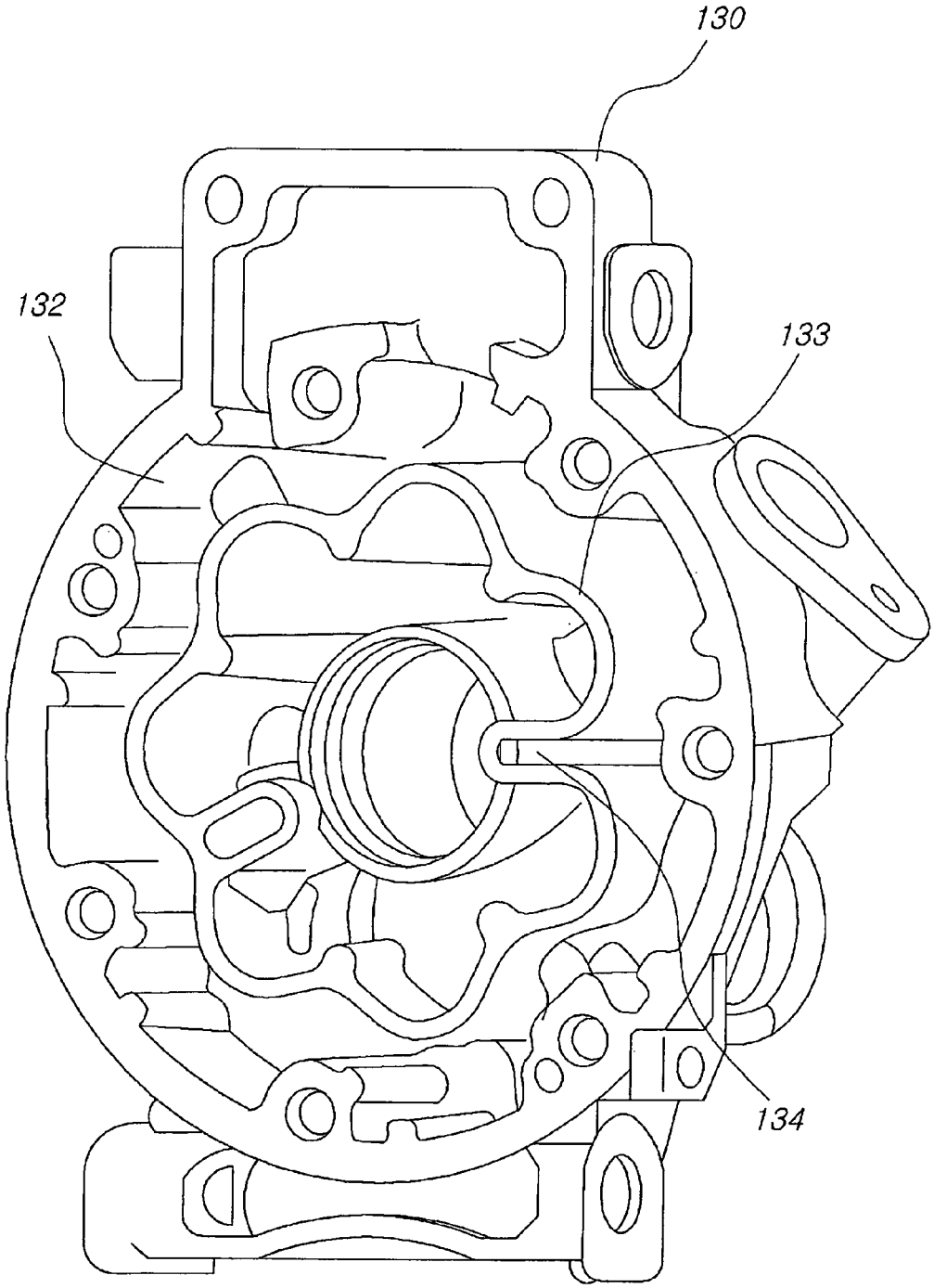

FIG. 2 is a cross-sectional view of a variable capacity swash plate type compressor according to an embodiment of the present invention, FIG. 3 is an exploded perspective view of a rotor, a swash plate, and a driving shaft illustrated in FIG. 2, FIG. 4 is a cross-sectional view of an operation of separating oil from a rotor and a driving shaft illustrated in FIG. 2, FIG. 5A is a front view of a front housing illustrated in FIG. 2, and FIGS. 5B and 5C are perspective views of a valve unit and a rear housing illustrated in FIG. 2.

As illustrated in FIG. 2, a variable capacity swash plate type compressor 100 according to an embodiment of the present invention comprises a cylinder block 110 in which a plurality of cylinder bores 111 are formed in an axial direction on a concentric circle, a front housing 120 which is mounted in front of the cylinder block 110 and in which a crank chamber 121 is formed, and a rear housing 130 which is mounted in rear of the cylinder block 110 and includes a defining wall 133 defining a suction chamber 132 and a discharge chamber 131.

A plurality of pistons 140 are inserted in each of the cylinder bores 111 of the cylinder block 110 to be interlocked with a swash plate 170 and to make a reciprocating motion. The front housing 120 is rotatably perforated at one end of a driving shaft 150, and the middle portion of the cylinder block 110 is inserted in the rear end of the driving shaft 150 so that the driving shaft 150 can be rotatably supported.

In addition, a rotor 160 is installed inside the crank chamber 121 and is connected to the driving shaft 150 and rotates together with the driving shaft 150. Here, a refrigerant communication passage 151 is formed inside the driving shaft 150 and communicates with the suction chamber 132.

A swash plate 170 is rotatably installed at a sleeve 165 that can be slid on the driving shaft 150 inside the crank chamber 121, and an edge of the swash plate 170 is rotatably connected to a shoe 145 inserted in a space in which a bridge 141 of the pistons 140 is inserted, and the swash plate 170 is connected to a hinge arm 163 of the rotor 160 to flow and rotates together with the rotor 160, and an angle of inclination of the swash plate 170 with respect to the driving shaft 150 is adjusted.

A valve unit 190 is installed between the cylinder block 110 and the rear housing 130, inhales a refrigerant into the cylinder bores 111 from the suction chamber 131 during a suction stroke of the pistons 140, and exhausts a compressed refrigerant to the discharge chamber 131 from the cylinder bores 111 during a compression stroke.

In addition, as illustrated in FIGS. 5B and 5C, the suction chamber 132 is formed outside the defining wall 133, and the defining wall 133 comprises a connection passage 134 so as to communicate the refrigerant communication passage 151 and the suction chamber 132 with each other, and a connection hole 191 may be formed in the valve unit 190.

Meanwhile, a control valve 200 is installed in the rear housing 130 so as to automatically communicate the discharge chamber 131 and the crank chamber 121 with each other. Thus, the control valve 200 changes a difference pressure between refrigerant suction in the cylinder bores 111 and a gas pressure in the crank chamber 121 so that an angle of inclination of the swash plate 170 can be adjusted.

In addition, an elastic body 155 that returns the swash plate 170 to its initial position is installed on the driving shaft 150 between the rotor 160 and the swash plate 170, and a bush 152 that supports rotation of the driving shaft 150 and simultaneously prevents leakage of the refrigerant may be further formed between the driving shaft 150 and the cylinder block 110.

At least one oil separation passage 161 is formed in the rotor 160 and the driving shaft 150. The oil separation passage 161 communicates the crank chamber 121 and the refrigerant communication passage 151 with each other, and along the oil separation passage 161, oil is centrifugally separated from a refrigerant gas flowing inside the oil separation passage 161 as the driving shaft 150 rotates, is formed in the rotor 160 and the driving shaft 150. Only one oil separation passage 161 may be formed, and a plurality of oil separation passages 161 may be formed if necessary. In addition, the size of an inner diameter of the oil separation passage 161 should be in the range in which the pressure of the crank chamber 121 is kept when the swash plate 170 operates variably.

At least one step portion 162 is formed on the oil separation passage 161 to reduce a cross-section of the step portion 162 in a direction of the refrigerant communication passage 151 from the crank chamber 121 toward the inner face of the step portion 162. Preferably, the step portion 162 is formed on the rotor 160. However, alternatively, the step portion 162 may be formed on the driving shaft 150. In addition, only one step portion 162 may be formed and a plurality of step portions 162 may be formed if necessary.

The operation of the variable capacity swash plate type compressor having the above structure according to the present invention will now be described with reference to FIGS. 2 through 5C.

Due to the operation of the compressor, the refrigerant gas in which oil remaining in the crank chamber 121 is included is flowed into the oil separation passage 161 formed in the rotor 160. The refrigerant gas passing the oil separation passage 161 rotates together with the rotor 150. Relatively heavy oil of the refrigerant gas passing the oil separation passage 161 is recovered to the crank chamber 121 along an inner wall of the oil separation passage 161 due to a centrifugal force. Meanwhile, the refrigerant gas passes a connection hole 191 of the valve unit 190 via the refrigerant communication passage 151 of the driving shaft 150 through the oil separation passage 161 and is exhausted to the suction chamber 132 via a connection passage 134 of the defining wall 133.

Meanwhile, the step portion 162 formed in the oil separation passage 161 prevents oil separated from the refrigerant gas from being flowed toward the refrigerant communication passage 151 of the driving shaft 150 together with the refrigerant to increase an oil separation effect. In other words, due to the characteristic of oil flowing along an inner wall if a centrifugal force acts, the step portion 162 acts as a defense wall to prevent oil from being flowed together with the refrigerant gas and to enable the oil to be recovered to the crank chamber 121.

Figure 6:
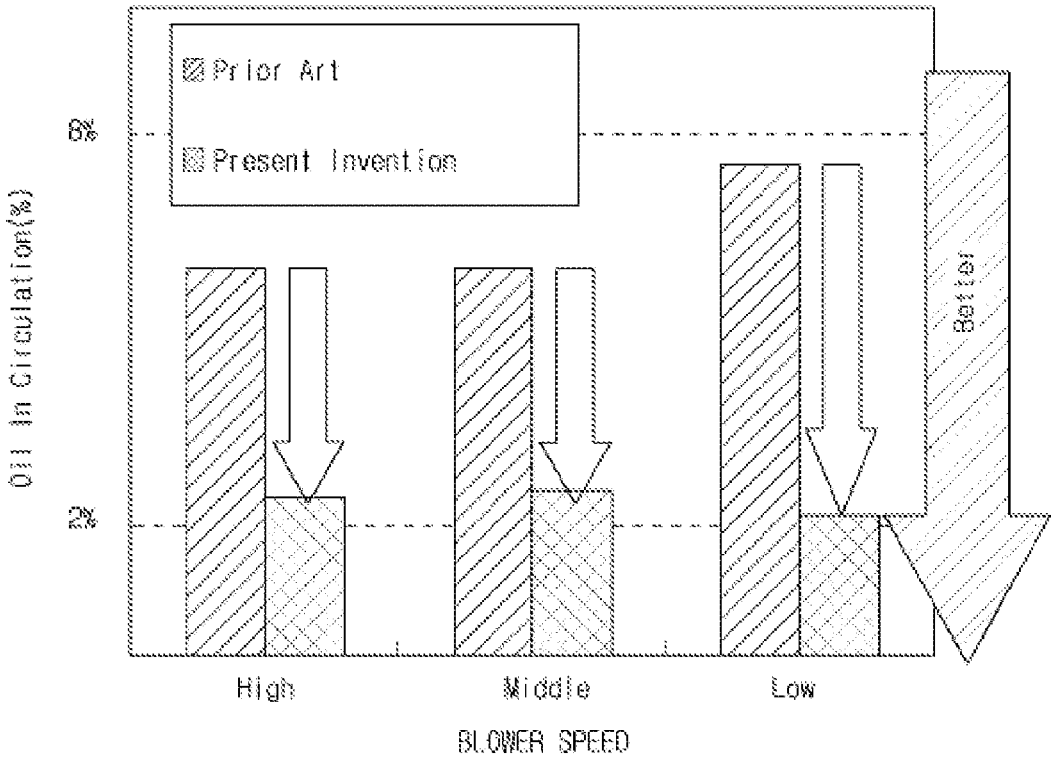
FIGS. 6 and 7 are graphs showing an oil separation effect according to an embodiment of the present invention.
Figure 7:
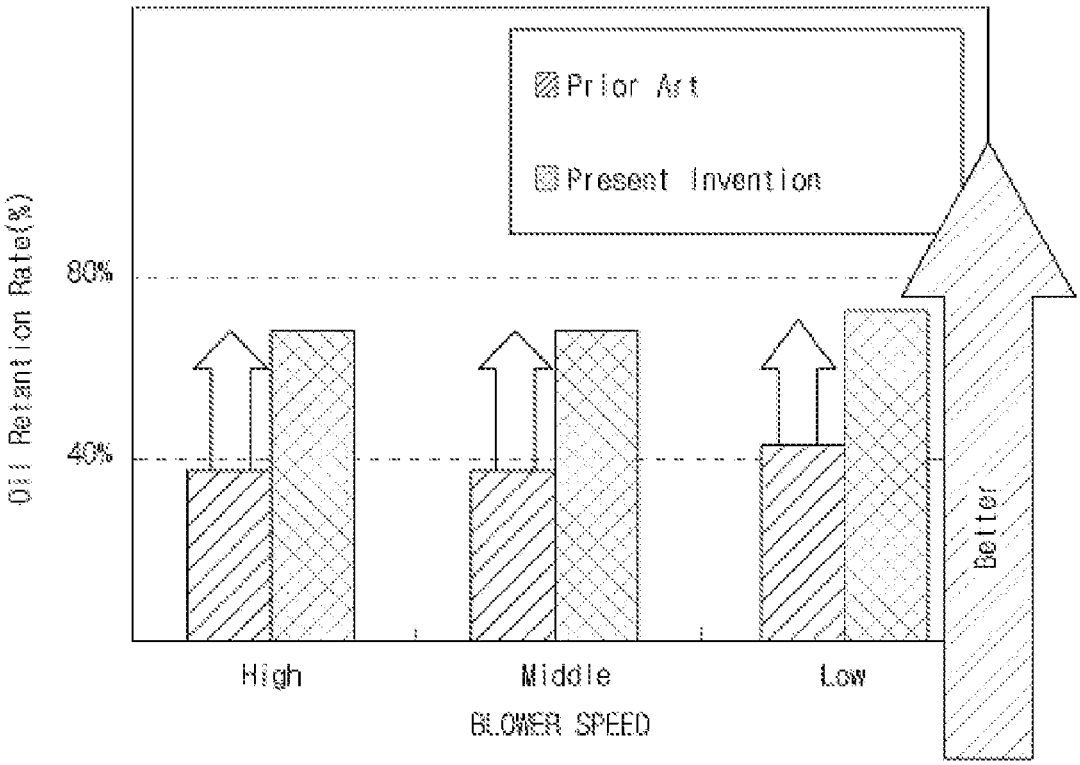

FIGS. 6 and 7 are graphs showing an oil separation effect according to an embodiment of the present invention.

FIG. 6 is a graph showing oil in circulation excluding a compressor when a variable capacity swash plate type compressor according to the present invention is used, which illustrates the ratio of oil quantity to (refrigerant quantity+oil quantity) in a refrigerant circuit excluding the compressor. According to the present invention, as illustrated in FIG. 6, oil in circulation excluding the compressor is reduced by nearly half or more than the case where the oil separation passage 161 of the present invention is not formed. Thus, the effect in which unnecessary oil is remarkably reduced in the refrigerant circuit occurs regardless of the speed of a blower.

Furthermore, as illustrated in FIG. 7, which illustrates oil retention rate in the compressor when the variable capacity swash plate type compressor according to the present invention is used, according to the present invention, the effect in which oil retention rate in the compressor in which oil is directly necessary is greatly increased compared to the case where the oil separation passage 161 of the present invention is not formed occurs regardless of the speed of the blower.

In other words, according to the present invention, an oil separation function can be sufficiently performed by using the oil separation passage 161 even without an additional oil separator.

While this invention has been particularly shown and described with reference to exemplary embodiments thereof, it will be understood by those skilled in the art that various changes in form and details may be made therein without departing from the spirit and scope of the invention as defined by the appended claims.

What is claimed is:

1. A variable capacity swash plate type compressor comprising:

a cylinder block having a plurality of cylinder bores;

a front housing mounted in front of the cylinder block and having a crank chamber formed therein;

a rear housing mounted in rear of the cylinder block and having a defining wall defining a suction chamber and a discharge chamber inside the rear housing;

a valve unit installed between the cylinder block and the rear housing for inhaling and exhausting a refrigerant;

a driving shaft in which a refrigerant communication passage communicating with the suction chamber is formed and which is rotatably installed on the cylinder block and the front housing;

a rotor connected to the driving shaft inside the crank chamber and rotating together with the driving shaft;

a swash plate connected to a hinge arm of the rotor to be movable and connected to the driving shaft so that an angle of inclination with respect to a change in the pressure of the crank chamber is changed;

an elastic body installed between the rotor and the swash plate and returning the swash plate to its initial position; and a plurality of pistons interlocking with rotation of the swash plate and making a reciprocating motion within the cylinder bores, wherein at least one oil separation passage having two ends is provided for communicating the crank chamber with the refrigerant communication passage, such that one end of the two ends is open at a position on a circumferential surface of the rotor and the other end of the two ends is open to the refrigerant communication passage in the driving shaft, and the oil separation passage includes at least one step portion in a middle portion thereof such that a cross-section of the at least one step portion is reduced toward a direction of the refrigerant communication passage from the crank chamber, so that oil is centrifugally separated from a refrigerant gas flowing inside the driving shaft as the driving shaft rotates.

2. The compressor of claim 1, wherein the step portion is formed in an oil separation passage within the rotor.

3. The compressor of claim 1, wherein the suction chamber is formed outside the defining wall, and the defining wall comprises a connection passage so that the refrigerant communication passage and the suction chamber communicate with each other, and a connection hole is formed in the valve unit.

4. The compressor of claim 1, further comprising a bush formed between the driving shaft and the cylinder block and supporting rotation of the driving shaft and simultaneously preventing leakage of a refrigerant.

* * * * *